US006332345B1

(12) United States Patent
Huang

(10) Patent No.: US 6,332,345 B1
(45) Date of Patent: Dec. 25, 2001

(54) KEY RING STRUCTURE

(76) Inventor: Yu-Hwei Huang, No. 8, Lane 42, Sec. 2, Nan Kan Rd., Lu Chu Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/699,498

(22) Filed: Oct. 31, 2000

(51) Int. Cl.[7] ..... A47G 29/10
(52) U.S. Cl. ..... 70/456 R; 70/459; 206/37.1
(58) Field of Search ..... 70/456 R, 456 B, 70/459, 460; 24/3.6; 206/37.1, 37.4–37.8, 38.1

(56) References Cited

U.S. PATENT DOCUMENTS

| | | | | |
|---|---|---|---|---|
| 2,791,899 | * | 5/1957 | Marien | 70/459 |
| 3,181,321 | * | 5/1965 | Gits | 70/456 R |
| 4,512,168 | * | 4/1985 | Reitze | 70/456 R |
| 4,584,858 | * | 4/1986 | Wolter | 70/456 R |
| 5,224,366 | * | 7/1993 | Huang | 70/456 R |
| 5,755,127 | * | 5/1998 | Huang | 70/456 R |
| 6,003,352 | * | 12/1999 | Yu | 70/456 R X |

FOREIGN PATENT DOCUMENTS

| | | | | |
|---|---|---|---|---|
| 318207 | * | 1/1920 | (DE) | 70/459 |
| 3017803 A1 | * | 12/1980 | (DE) | 24/3.6 |
| 2572262 | * | 5/1986 | (FR) | 70/456 R |
| 614224 | * | 12/1960 | (IT) | 70/459 |
| 617265 | * | 2/1961 | (IT) | 70/456 R |

* cited by examiner

*Primary Examiner*—Lloyd A. Gall
(74) *Attorney, Agent, or Firm*—Rosenberg, Klein & Lee

(57) ABSTRACT

A key ring structure comprises an assembled disk, a ring, and a button. The assembled disk is formed by a lower piece and an upper piece. An annular groove is formed between the upper piece and the lower piece. The opening of the groove faces toward a circumference of the disk. The lower piece and upper piece are installed with a first recess and a second recess. The first recess and the second recess are installed with respect to one another and are installed at two sides of the groove so that the groove is formed with a movable opening; and the movable opening faces outwards. The head of the ring body is slidably installed to the groove of the disk. The head is capable of being moved out or placed in the groove through the disk. A button has a button body. The button body is installed in the disk. A restoring spring is disposed between the button body and the disk. The button is movable along the disk. One side of the button body extends outwards so as to be formed as a stopper. The stopper is movably matched with the recess for controlling opening and closing of the movable opening. Therefore, a key ring structure is formed, in which the movable opening on the disk can be opened or closed easily and conveniently, the finger will not feel ache. Furthermore, key can be placed in or removed from the key ring structure of the present invention.

6 Claims, 5 Drawing Sheets

A-A

KEY RING STRUCTURE

FIELD OF THE INVENTION

The present invention relates to a key ring structure, in which the movable opening on a disk can be opened or closed by a button axially moving along an axial direction of a disk.

BACKGROUND OF THE INVENTION

The prior art key ring structure serves to place a plurality of key ring bodies for hanging more keys. Furthermore, the key ring bodies can be taken out or placed in the ring body flexibly.

The U.S. Pat. No. 4,584,858 discloses a key ring structure (referring to FIGS. 1 and 2). The key ring structure has a disk 10, at least one ring body 20 and a sliding device 30. The disk 10 is placed with a ring body 20. Each ring body 20 has an arm 21 and a head 22. The ring body 20 serves to hang keys 40. The head 22 is slidable installed in a groove 11 of the disk 10. The opening of the groove 11 faces to the circumference of the disk 10. The groove 11 is installed with a movable opening 12. The head 22 can be taken out from or placed in the groove 11 through this opening 12. The movable opening 12 is formed by an enlarged cross section of the groove 11 facing outwards. The sliding device 30 serves to reduce the cross section of the movable opening 12 so as to be smaller than the cross section of the head 22, and therefore, the movable opening 12 can be closed (see FIG. 1). Therefore, the head 22 is prevented from separation with the movable opening 12. The sliding device 30 and the groove 11 are formed with a cross section of a channel so as to be passed by the head 22 and the arm 21. When the sliding device 30 moves downwards radially along the disk 10, the movable opening 12 can be opened (see FIG. 2) so as to be formed with a cross section of a channel. Therefore, the head 22 of the ring body 20 can be taken out or placed into the groove 11 for increasing or decreasing the number of the rings 20.

However, in the aforesaid prior art ring, the sliding device 30 is opened through a handle 31 for controlling. The handle 31 is a smaller post and the sliding device 30 resists against a restoring spring 32 for providing a restoring force for closing the sliding device 30. Therefore, as the user pushes the handle 31, the operation is inconvenient and needs a larger force, even the finger will feel ache and thus the operations of taking out a ring body 20 or placing into the ring body 20 are inconvenient.

SUMMARY OF THE INVENTION

Accordingly, the primary object of the present invention is to provide a key ring structure, in which the movable opening on the disk can be opened or closed easily and conveniently by a button. The finger will not feel ache. Furthermore, the button axially moves along the disk so as to have a large area for pressing the button body. The finger will not feel uneasy and thus passing of the ring body is convenient.

To achieve the object, the present invention provides a key ring structure comprising an assembled disk, a ring, and a button.

The assembled disk is formed by a lower piece and an upper piece. An annular groove is formed between the upper piece and the lower piece. The opening of the groove faces toward a circumference of the disk. The lower piece and upper piece are installed with a first recess and a second recess. The first recess and the second recess are installed with respect to one another and are installed at two sides of the groove so that the groove is formed with a movable opening; and the movable opening faces outwards.

The head of the ring body is slidably installed to the groove of the disk. The head is capable of being moved out or placed in the groove through the disk.

The button has a button body. The button body is installed in the disk. A restoring spring is disposed between the button body and the disk. The button is movable along the disk. One side of the button body extends outwards so as to be formed as s stopper. The stopper is movably matched with the recess for controlling opening and closing of the movable opening. Therefore, a key ring structure is formed.

The various objects and advantages of the present invention will be more readily understood from the following detailed description when reading in conjunction with the appended drawing.

DETAILED DESCRIPTION OF THE PREFERRED EMBODIMENTS

Figure 2:
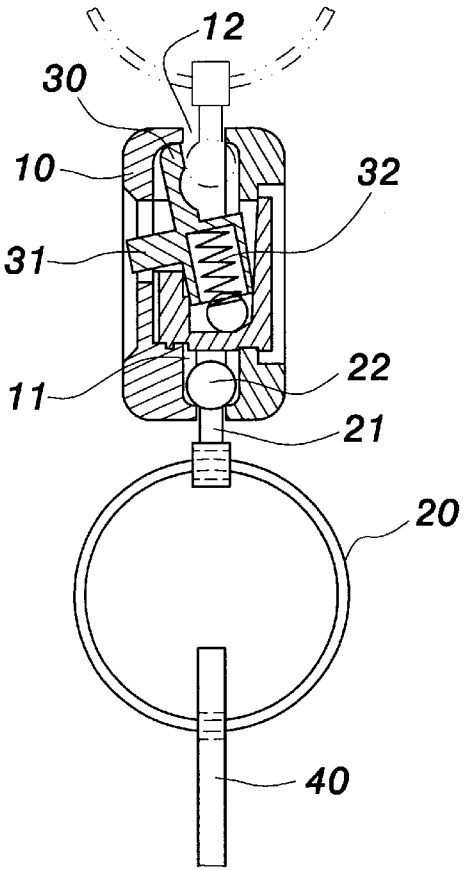
FIG. 2 PRIOR ART
FIG. 2 shows an application of the prior art key ring structure.
Figure 1:
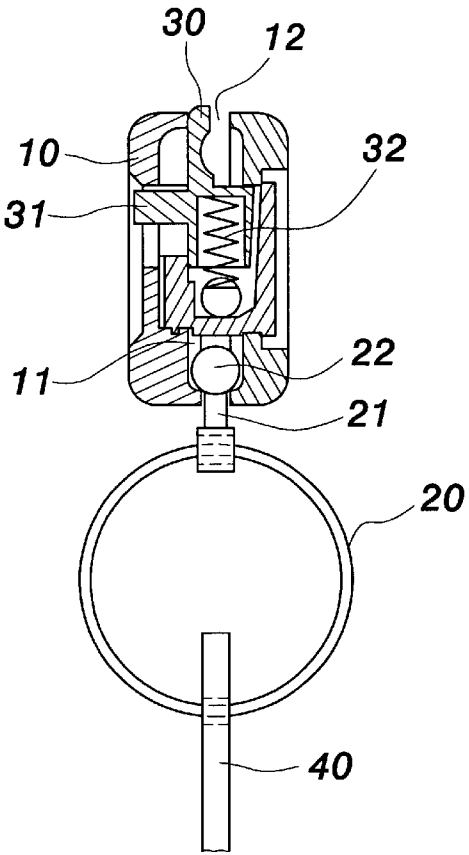
FIG. 1 PRIOR ART
FIG. 1 is a cross sectional view of a prior art key ring structure.
Figure 3:
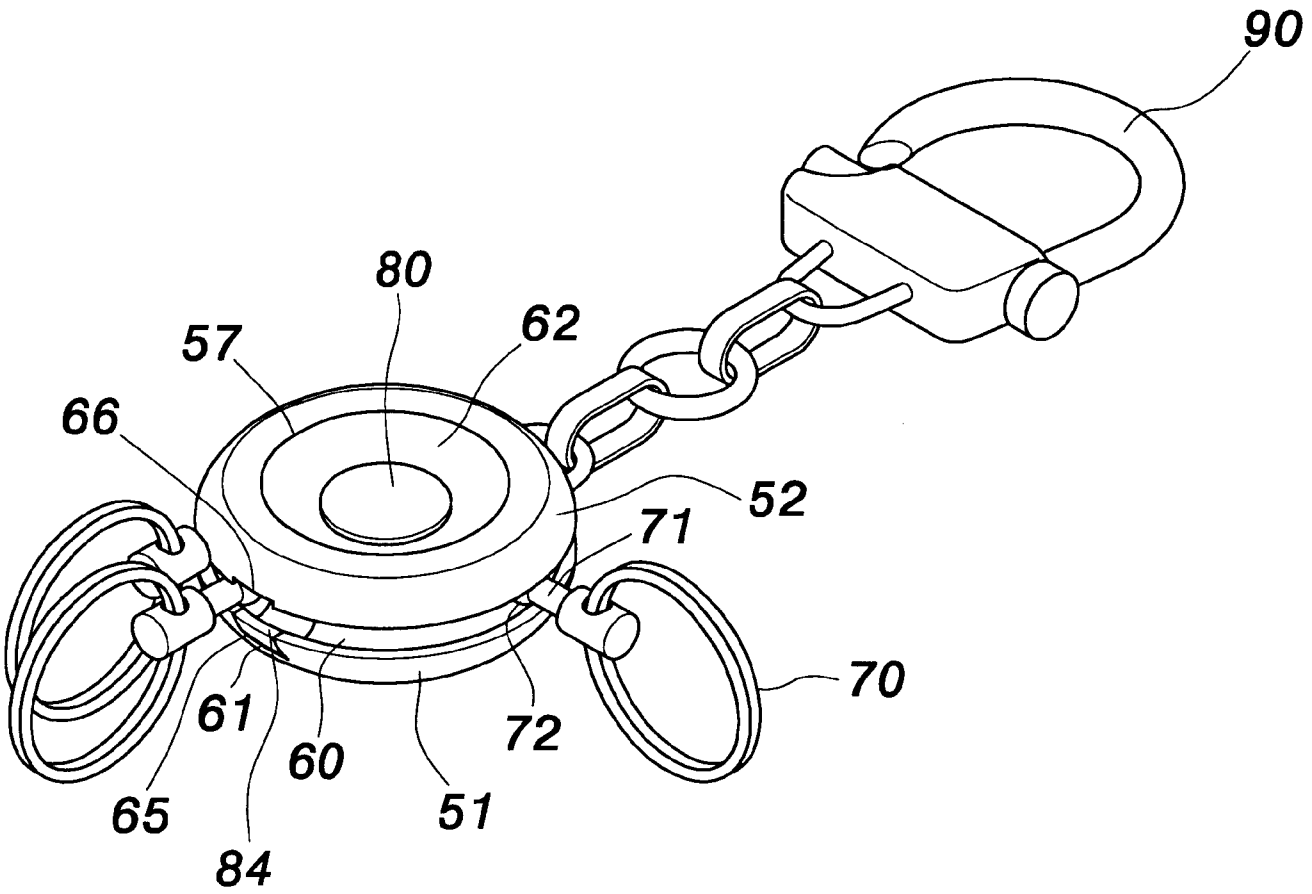
FIG. 3 is an assembled perspective view of the present invention.
Figure 4:
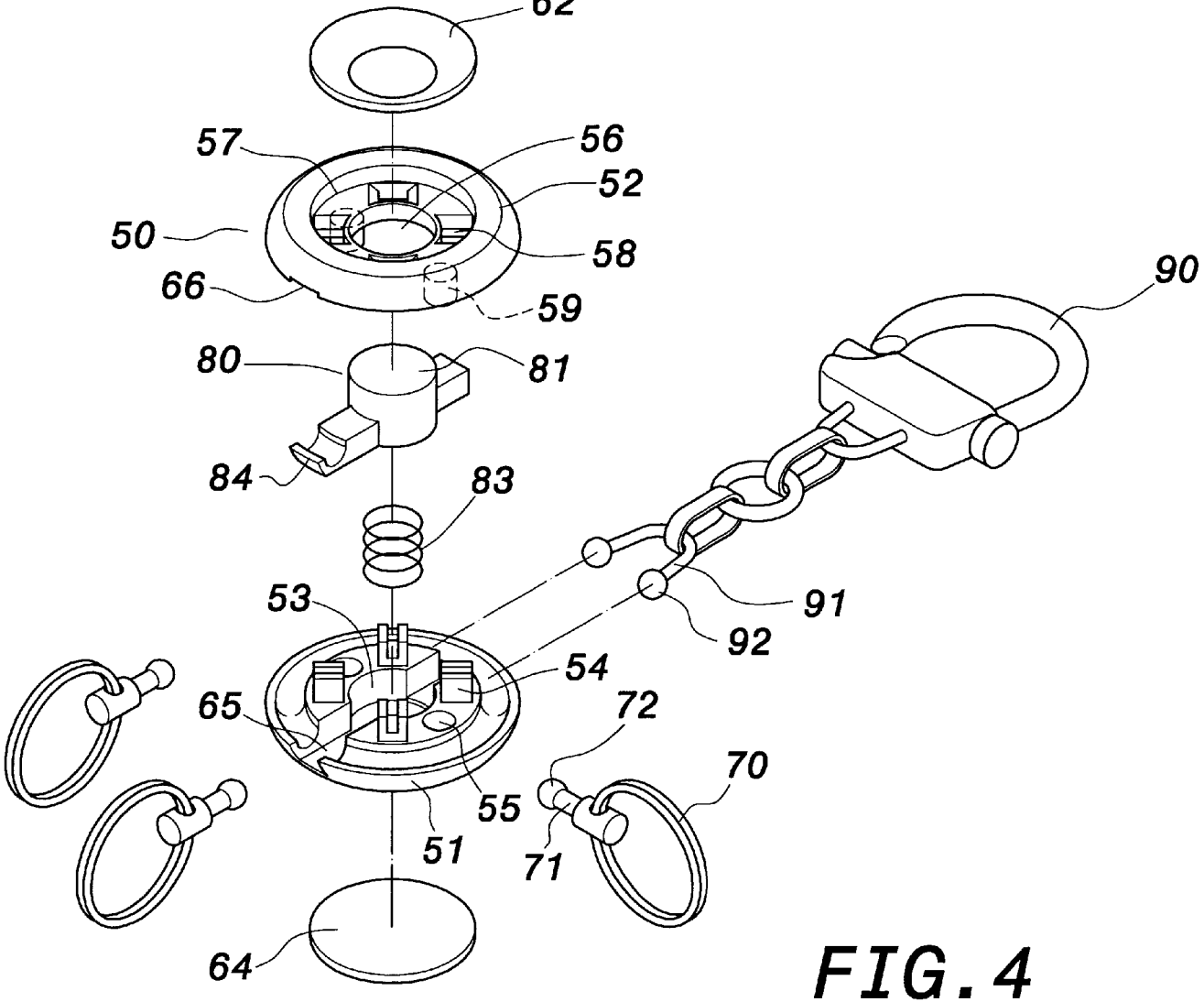
FIG. 4 is an exploded perspective view of the present invention.
Figure 5:
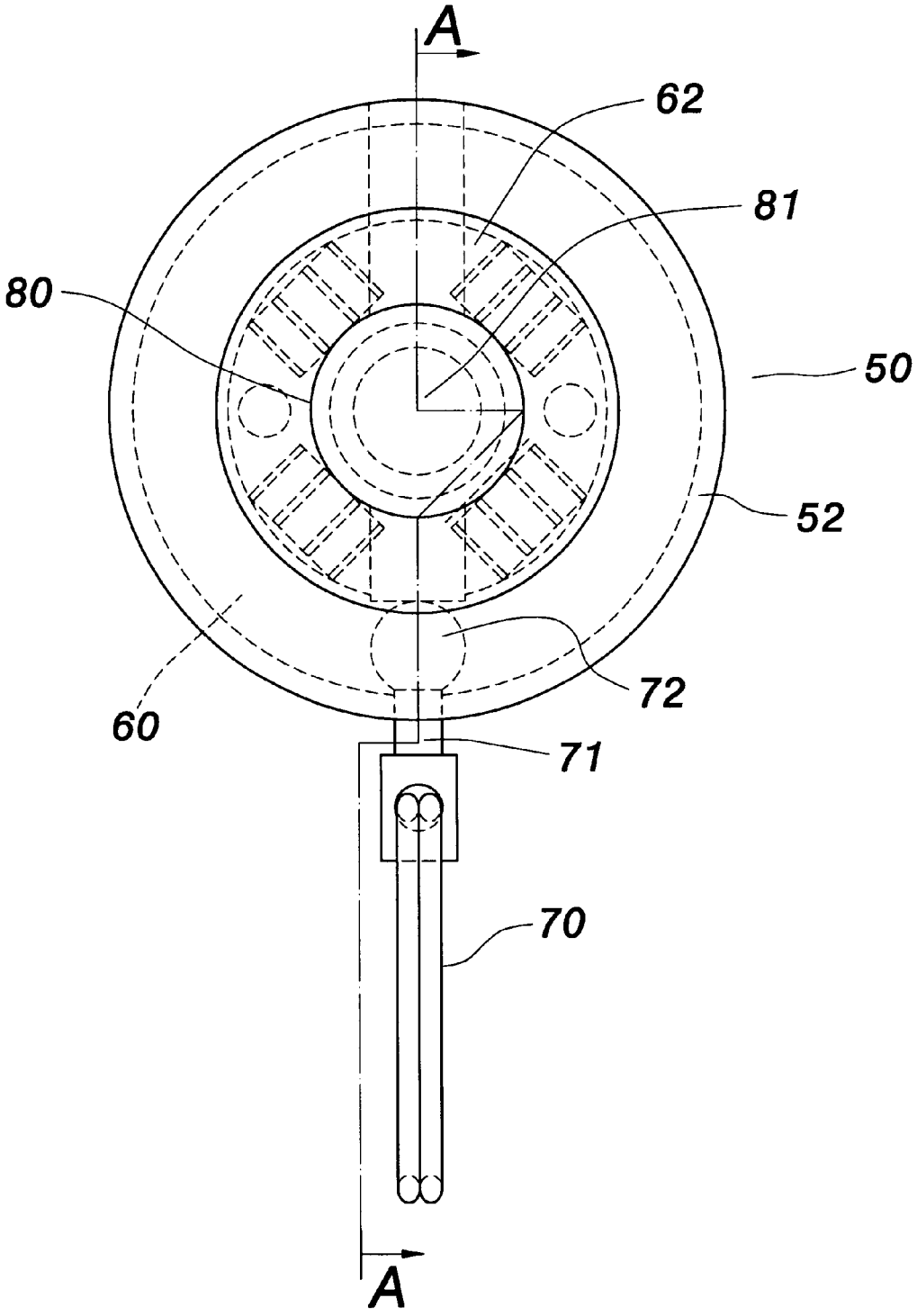
FIG. 5 is a plane view of the present invention.

Referring to FIGS. 3 to 5, the key ring structure of the present invention is illustrated. The key ring structure of the present invention includes an assembled disk 50, at least one ring body 70, and a button 80.

The disk 50 is formed by a lower piece 51 and an upper piece 52. The lower piece 51 is installed with a receiving groove 53 and a plurality of rivet posts 54 having a U shape and a round positioning hole 55. The upper piece 52 is installed with a button through hole 56. A centering axis of the disk extends through the hole 56 and the groove 53. An embedding groove 57 is installed at an outer side of the button through hole 56 of the upper piece 52. The upper piece 52 is further installed with a rivet hole 58 and positioning post 59 with respect to the rivet post 54 and the positioning hole 55. The lower piece 51 and upper piece 52 are accurately positioned by the engagement of positioning hole 55 and the positioning post 59. Then, by the rivet post 54 mating with the rivet hole 58, the end portion of the rivet post 54 is separated, and thus the rivet post 54 and the rivet hole 58 are combined by riveting. Therefore, the lower piece 51 and upper piece 52 are assembled as a round disk 50.

An annular decorating piece 62 is embedded in the embedding groove 57 so as to be more beautiful. The lower piece 51 is installed with an embedding groove 63 for being embedded with another decorating piece 64. The decorating piece 64 is installed with characters or patterns for advertising or decoration. When the lower piece 51 and the upper piece 52 are assembled as an integral body, a round groove 60 is formed between the upper piece 52 and the lower piece 51. The opening of the groove 60 faces toward the circumference of the disk 50. The groove 60 is installed with a movable opening 61. The movable opening 61 is formed by an enlarged cross section of the groove 60. The lower piece 51 and upper piece 52 are installed with a first recess 65 and a second recess 66. The first recess 65 and the second recess 66 are installed with respect to one another and are installed at two sides of the groove so that the groove 60 is formed with a movable opening 61 having an enlarged cross section. The movable opening 61 faces outwards.

The ring body 70 has an arm 71 and a head 72. The ring body 70 can be hung with keys (not shown). The head is slidably installed to the groove 60 of the disk 50 so that the ring body 70 can be placed on the disk 50. The head 72 can be moved out or placed in the groove 60 through the opening 61 of the disk 50.

The button 80 has a button body 81. A spring chamber 82 is formed in the button body 81 for receiving a restoring spring 83. The button body 81 is installed in the receiving groove 53 of the disk 50. The top of the button body 81 passes out through the button through hole 56 of the disk 50 so as to be pressed by users. The restoring spring 83 is disposed between the button body 81 of the button 80 and the lower piece 51 of the disk 50 for providing a resilient force to restore the button body 81. One side of the button body 81 extends outwards so as to be formed as a stopper 84. The stopper 84 is movably matched with the recess 65 for controlling the opening and closing of the movable opening 61. By aforesaid structure, the key ring structure of the present invention is formed.

Figure 6:
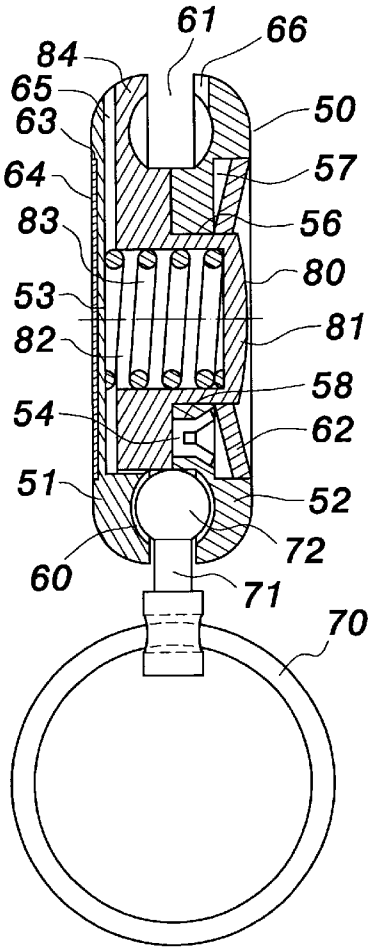
FIG. 6 is cross sectional view along line A—A of FIG. 5.

Referring to FIG. 6, the restoring spring 83 may push the button 80 to be axially moved along the disk 50 toward the upper piece 52 so that the stopper 84 of the movable opening 61 provides a stopper effect, therefore, the movable opening 61 can be closed (as shown in FIG. 6). Therefore, the head 72 is prevented from separating with the movable opening 61. The button 80 and the groove 60 are formed with a through hole for passing the head 72 and the arm 71. Thus, the ring body 70 may freely move on the disk 50.

Figure 8:
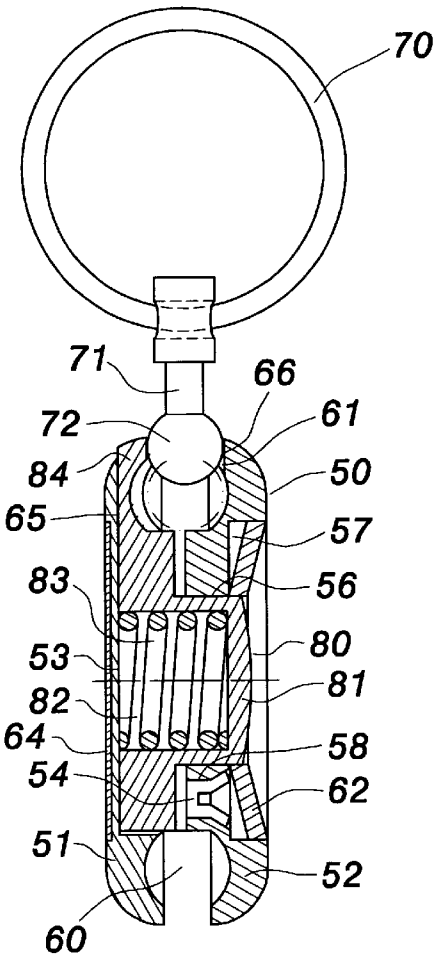
FIG. 8 is a schematic view showing another application of the present invention.
Figure 7:
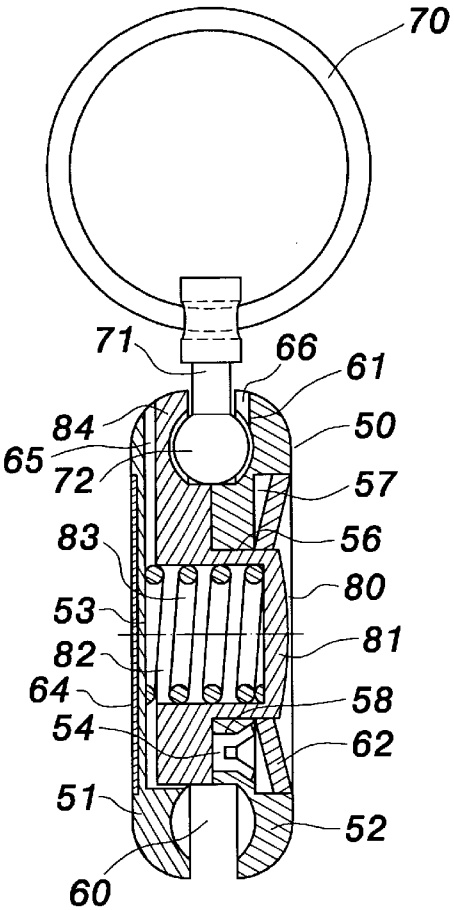
FIG. 7 is a schematic view showing an application of the present invention.

Referring to FIGS. 7 and 8, when the user presses the button body 81 of the button 80, the button 80 may axially move along the disk 50 toward the lower piece 51 so that the stopper 84 of the button 80 is completely received in the first recess 65 for opening the movable opening 61 (as shown in FIG. 8) so as to be formed with a through hole which may be passed through by the head 72 and the arm 71. As a result, the head 72 of the ring body 70 may be moved out or placed in the recess 60 for increasing or decreasing the number of rings.

Furthermore, the disk 50 may be used to place a hook 90 (as shown in FIGS. 3 and 4) so that the present invention can be suspended from the belt of trousers through the hook 90. The hook 90 has an arm 91 and a head 92. The head 92 is slidably installed in the groove 60 of the disk 50, as a result, the hook 90 is placed in the disk 50. Through the opening 61 of the disk 50, the head 92 can be moved out or placed in the groove 60.

In the key ring structure of the present invention, the opening of the button 80 is controlled through a button body 81. The button body 81 is operated by pressing. The user presses the button body 81 by a finger easily and conveniently and the button 80 axially moves along the disk 50 so as to have a large area for pressing the button body 81. The finger will not feel uneasy and thus object can pass through the ring body 70 conveniently.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A key ring structure comprising:

an assembled disk formed by a lower piece and an upper piece; an annular groove being formed between the upper piece and the lower piece; an opening of the groove facing toward a circumference of the disk; the lower piece and upper piece being installed with a first recess and a second recess; the first recess and the second recess being installed with respect to one another and being installed at two sides of the groove so that the groove is formed with a movable opening; and the movable opening faces outwards;

at least one ring body having an arm and a head; the head being slidably installed in the groove of the disk; the head is capable of being moved out or placed in the groove through the disk; and a button having a button body; the button body being installed in the disk; a restoring spring being disposed between the button body and the disk; the button is movable along the disk; one side of the button body extending outwards so as to be formed as a stopper; the stopper being movably matched with the recess; the button body is movable in an axial direction which is generally parallel to a centering axis of the disk for controlling opening and closing of the movable opening.

2. The key ring structure as claimed in claim 1, wherein the lower piece is installed with a plurality of rivet posts and a plurality of positioning holes, and the upper piece is further installed with a plurality of rivet holes and positioning posts with respect to the rivet posts and the positioning holes; the lower piece and upper piece are positioned by the engagement of respective holes and the respective posts; and by the rivet posts and the rivet holes being combined by riveting; therefore, the lower piece and upper piece are assembled as an integral body.

3. The key ring structure as claimed in claim 1, wherein the disk is installed with a receiving groove and a button through hole, the button body is installed in the receiving groove; and a top of the button body protrudes out from the button through hole.

4. The key ring structure as claimed in claim 1, wherein the disk is installed with an embedding groove for being embedded with a decorating piece.

5. The key ring structure as claimed in claim 1, wherein a spring chamber is formed in the button body, and the restoring spring is received in the spring chamber.

6. The key ring structure as claimed in claim 1, wherein the disk is placed with a hook, the hook has an arm and a head; the head of the hook is slidably installed in the groove of the disk; through the opening of the disk, the head of the hook is capable of being moved out of or placed in the groove.

* * * * *